US011142719B2

(12) United States Patent
Cant et al.

(10) Patent No.: US 11,142,719 B2
(45) Date of Patent: Oct. 12, 2021

(54) LUBRICATING OIL COMPOSITION

(71) Applicant: Infineum International Limited, Abingdon (GB)

(72) Inventors: Alastair A. Cant, Didcot (GB); Adam P. Marsh, Witney (GB); Robert W. Shaw, Abingdon (GB); Thomas D. Wilkinson, Abingdon (GB)

(73) Assignee: INFINEUM INTERNATIONAL LIMITED

( * ) Notice: Subject to any disclaimer, the term of this patent is extended or adjusted under 35 U.S.C. 154(b) by 0 days.

(21) Appl. No.: 15/287,801

(22) Filed: Oct. 7, 2016

(65) Prior Publication Data

US 2017/0101598 A1 Apr. 13, 2017

(30) Foreign Application Priority Data

Oct. 8, 2015 (EP) ..... 15188998

(51) Int. Cl.

| | |
|---|---|
| ***C10M 129/54*** | (2006.01) |
| ***C10M 159/22*** | (2006.01) |
| ***C10M 159/24*** | (2006.01) |
| ***C10M 159/20*** | (2006.01) |
| ***C10M 135/10*** | (2006.01) |
| *C10N 10/04* | (2006.01) |
| *C10N 30/04* | (2006.01) |
| *C10N 30/10* | (2006.01) |
| *C10N 30/00* | (2006.01) |
| *C10N 40/25* | (2006.01) |

(52) U.S. Cl.

CPC ..... *C10M 129/54* (2013.01); *C10M 135/10* (2013.01); *C10M 159/20* (2013.01); *C10M 159/22* (2013.01); *C10M 159/24* (2013.01); *C10M 2207/144* (2013.01); *C10M 2207/262* (2013.01); *C10M 2219/044* (2013.01); *C10M 2219/046* (2013.01); *C10N 2010/04* (2013.01); *C10N 2030/04* (2013.01); *C10N 2030/10* (2013.01); *C10N 2030/45* (2020.05); *C10N 2040/25* (2013.01); *C10N 2040/252* (2020.05); *C10N 2040/255* (2020.05)

(58) Field of Classification Search

CPC ..... C10M 2219/044; C10N 2010/02

USPC ..... 508/390

See application file for complete search history.

(56) References Cited

U.S. PATENT DOCUMENTS

| | | | |
|---|---|---|---|
| 5,061,390 | A | 10/1991 | Small, Jr. et al. |
| 2006/0281645 | A1 | 12/2006 | Bell et al. |
| 2015/0322367 | A1 | 11/2015 | Patel et al. |

FOREIGN PATENT DOCUMENTS

| | | | | |
|---|---|---|---|---|
| EP | 1310549 | A1 | 5/2003 | |
| GB | 818323 | A * | 8/1959 | ..... C07C 51/414 |
| WO | 2008013755 | A2 | 1/2008 | |
| WO | WO-2015042340 | A1 | 3/2015 | |
| WO | WO-2015114920 | A1 | 8/2015 | |

* cited by examiner

*Primary Examiner* — Vishal V Vasisth

(57) ABSTRACT

A lubricating oil composition for reducing low-speed pre-ignition events or improving oxidation in a spark-ignited direct injection engine is disclosed. The composition includes a detergent additive which comprises either: an oil-soluble sulfonate including both magnesium and calcium as cations; or an oil-soluble salicylate including both magnesium and calcium as cations.

23 Claims, No Drawings

LUBRICATING OIL COMPOSITION

FIELD OF THE INVENTION

The present invention relates to reducing the occurrence of Low Speed Pre-Ignition (LSPI) (or low speed pre-ignition events) in spark-ignited internal combustions engines, in which a lubricating oil composition having a defined detergent additive is used to lubricate the engine crankcase.

BACKGROUND OF THE INVENTION

Market demand, as well as governmental legislation, has led automotive manufacturers to continuously improve fuel economy and reduce $CO_2$ emissions across engine families, while simultaneously maintaining performance (horsepower). Using smaller engines providing higher power densities, increasing boost pressure by using turbochargers or superchargers to increase specific output, and downspeeding the engine by using higher transmission gear ratios allowed by higher torque generation at lower engine speeds have allowed engine manufacturers to provide excellent performance while reducing frictional and pumping losses. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure. The possibility of LSPI prevents engine manufacturers from fully optimizing engine torque at lower engine speed in such smaller, high-output engines.

The art addresses this problem. For example, SAE 2013-01-2569 ("Investigation of Engine Oil Effect on Abnormal Combustion in Turbocharged Direct Injection-Spark Ignition Engines (Part 2)" by Hirano et al) concludes that increasing calcium concentration leads to greater LSPI frequency.

Further, WO2015/042340 A1 describes use of a metal overbased detergent selected from sulfonate, phenate, and salicylate detergents to meet the problem. A mixture of Mg sulfonate and Ca sulfonate is exemplified.

SUMMARY OF THE INVENTION

It has now been found that use of mixed metal overbased detergents gives rise to improved performance in LSPI (and also in oxidation) in comparison with corresponding mixtures of overbased detergents.

Thus, the present invention provides, in a first aspect, a method for reducing low-speed pre-ignition events and/or improving oxidation performance in a spark-ignited direct injection internal combustion engine comprising lubricating the crankcase of the engine with a lubricating oil composition which comprises a detergent additive comprising an oil-soluble basic organic acid salt including at least magnesium and calcium as cations, wherein the organic acid is a hydroxy-benzoic acid or a sulfonic acid.

In a second aspect, the invention provides the use of a detergent additive comprising an oil-soluble basic organic acid salt containing at least magnesium and calcium as cations, wherein the organic acid is a hydroxy-benzoic acid or a sulfonic acid, in a lubricating oil composition to reduce low-speed pre-ignition events and/or improve oxidation performance, in comparison with an analogous composition containing a mixture of separate magnesium and calcium salts, when the composition lubricates the crankcase of a spark-ignited direct injection internal combustion engine.

The detergent additive is either: an oil-soluble hydroxybenzoate including at least magnesium and calcium as cations; or an oil soluble sulfonate including at least magnesium and calcium as cations. The detergent is not a mixture of an oil-soluble magnesium detergent and an oil-soluble calcium detergent. The detergent additive is prepared in the presence of both magnesium and calcium compounds such as, for example, a magnesium oxide (or hydroxide) and a calcium oxide (or hydroxide), before the overbasing step with, for example, carbon dioxide (or before the final overbasing step if there is more than one).

By "mixed metal detergent", we mean a single oil-soluble overbased detergent that includes as cations at least two different metals which are calcium and magnesium. Further information about mixed metal detergents can be found in GB 818,323: 'Process for the preparation of Oil-Soluble Basic Organic Acid Salts containing as Cations two or more different Metals'.

In this specification, the following words and expressions, if and when used, have the meanings ascribed below:

- "active ingredient" or "(a.i.)" refers to additive material that is not diluent or solvent;
- "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;
- "hydrocarbyl" means a chemical group of a compound that normally contains only hydrogen and carbon atoms and that is bonded to the remainder of the compound directly via a carbon atom but that may contain hetero atoms provided that they do not detract from the essentially hydrocarbyl nature of the group;
- "oil-soluble" or "oil-dispersible", or cognate terms, do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;
- "major amount" means in excess of 50 mass % of a composition, preferably in excess of 60 mass % of a composition, more preferably in excess of 70 mass % of a composition, and most preferably in excess of 80 mass % of a composition;
- "minor amount" means 50 mass % or less, preferably 40 mass % or less, more preferably 30 mass % or less, and most preferably 20 mass % or less, of a composition;
- "TBN" means total base number as measured by ASTM D2896 in units of mg $KOHg^{-1}$;
- "phosphorus content" is measured by ASTM D5185;
- "sulfur content" is measured by ASTM D2622; and
- "sulfated ash content" is measured by ASTM D874.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Furthermore, the constituents of this invention may be isolated or be present within a mixture and remain within the scope of the invention.

DETAILED DESCRIPTION OF THE INVENTION

LPSI

Several terms exist for various forms of abnormal combustion in spark-ignited internal combustion engines including knock, extreme knock (sometimes referred to as super-knock or mega-knock), surface ignition, and pre-ignition (ignition occurring prior to spark ignition). Extreme knock occurs in the same manner as traditional knock, but with increased knock amplitude, and can be mitigated using traditional knock control methods. LSPI usually occurs at low speeds and high loads. In LSPI, initial combustion is relatively slow and similar to normal combustion, followed by a sudden increase in combustion speed. LSPI is not a runaway phenomenon, unlike some other types of abnormal combustion. Occurrences of LSPI are difficult to predict, but are often cyclical in nature.

Low Speed Pre-Ignition (LSPI) is most likely to occur in direct-injected, boosted (turbocharged or supercharged), spark-ignited (gasoline) internal combustion that, in operation, generate a break mean effective pressure level of greater than about 1,500 kPa (15 bar) (peak torque), such as at least about 1,800 kPa (18 bar), particularly at least about 2,000 kPa (20 bar) at engine speeds of from about 1500 to about 2500 rotations per minute (rpm), such as at engine speeds of from about 1500 to about 2000 rpm. As used herein, break mean effective pressure (BMEP) is defined as the work accomplished during on engine cycle, divided by the engine swept volume, the engine torque normalized by engine displacement. The word "brake" denotes the actual torque or power available at the engine flywheel, as measured on a dynamometer. Thus, BMEP is a measure of the useful power output of the engine.

It has now been found that the occurrence of LSPI in engines susceptible to the occurrence of LSPI can be reduced by lubricating such engines with lubricating oil compositions as defined above under "Summary of the Invention".

Lubricating Oil Compositions

Lubricating oil compositions of the invention may be those suitable for use as passenger car motor oils and conventionally comprise a major amount of oil of lubricating viscosity and minor amounts of performance enhancing additives, including ash-containing detergents. Examples of suitable detergent additives in the invention include, but are not limited to, one or more mixed calcium and magnesium overbased salicylates or sulfonates.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998, which categorizes base stocks as follows:

a) Group I base stocks contain less than 90 percent saturates and/or greater than 0.03 percent sulfur and have a viscosity index greater than or equal to 80 and less than 120 using the test methods specified in Table E-1.
b) Group II base stocks contain greater than or equal to 90 percent saturates and less than or equal to 0.03 percent sulfur and have a viscosity index greater than or equal to 80 and less than 120 using the test methods specified in Table E1.
c) Group III base stocks contain greater than or equal to 90 percent saturates and less than or equal to 0.03 percent sulfur and have a viscosity index greater than or equal to 120 using the test methods specified in Table E-1.
d) Group IV base stocks are polyalphaoiefins (PAO).
e) Group V base stocks include all other base stocks not included in Group I, II, III, or IV.

Typically, the base stock will have a viscosity preferably of 3-12, more preferably 4-10, most preferably 4.5-8, $mm^2/s$ at 100° C.

TABLE E-1

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

Preferably, the oil of lubricating viscosity comprises greater than or equal to 10, more preferably greater than or equal to 20, even more preferably greater than or equal to 25, even more preferably greater than or equal to 30, even more preferably greater than or equal to 40, even more preferably greater than or equal to 45, mass % of a Group II or Group III base stock, based on the total mass of the oil of lubricating viscosity. Even more preferably, the oil of lubricating viscosity comprises greater than 50, preferably greater than or equal to 60, more preferably greater than or equal to 70, even more preferably greater than or equal to 80, even more preferably greater than or equal to 90, mass % of a Group II or Group III base stock, based on the total mass of the oil of lubricating viscosity. Most preferably, the oil of lubricating viscosity consists essentially of a Group II and/or Group III base stock. In some embodiments the oil of lubricating viscosity consists solely of Group II and/or Group III base stock. In the latter case it is acknowledged that additives included in the lubricating oil composition may comprise a carrier oil which is not a Group II or Group III base stock.

Other oils of lubricating viscosity that may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oil comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation, are known to those skilled in the art. Re-refined oils are obtained by processes similar to those used to obtain refined oils applied to refined oils that have been already used in service. Such re-refitted oils are also known as reclaimed or reprocessed oils and often are additionally processed by techniques for treating spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The oil of lubricating viscosity may also comprise a Group I, Group IV or Group V base stocks or base oil blends of the aforementioned base stocks.

Preferably, the volatility of the oil of lubricating viscosity or oil blend, as measured by the NOACK test (ASTM D5880), is less than or equal to 18, preferably less than or equal to 14, more preferably less than or equal to 12, most preferably less than or equal to 10, %. Preferably, the viscosity index (VI) of the oil of lubricating viscosity is at least 95, preferably at least 110, more preferably at least 120, even more preferably at least 125, most preferably from 130 to 140.

Preferably, the lubricating oil composition is a multigrade oil identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 15 WX, SAE 10WX, SAE 5WX or SAE 0WX, wherein X represents any one of 20, 30, 40 and 50. Preferably X is 20, 30 or 40.

Detergent Additive

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and have a total base number or TBN (as can be measured by ASTM D2896) of from 0 to less than 150, such as 0 to about 80 or 100. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents have a TBN of 150 or greater, and typically will have a TBN of from 250 to 450 or more.

Detergents that may be used in all aspects of the present invention include oil-soluble neutral and overbased sulfonates or salicylates that are hydrocarbyl substituted.

Sulfonic acids, as the organic acid, may be obtained by sulfonating hydrocarbyl-substituted, especially alkyl-substituted, aromatic hydrocarbons such as those obtained from fractionating petroleum by distillation and/or extraction, or by alkylating aromatic hydrocarbons. Examples include those obtained by alkylating benzene, toluene, xylene, naphthalene, biphenyl or their halogen derivatives, for example chlorobenzene, chlorotoluene or chloronaphthalene. Aromatic hydrocarbons may be alkylated with alkylating agents having 3 to 100 carbon atoms in the presence of a catalyst. Examples of alkylating agent include haloparaffins, olefins obtained by dehydrogenating paraffins, and polyolefins such as polymers of ethylene, propylene, and/or butene. Alkylaryl sulfonic acids usually contain from 7 to 100 or more, preferably 16 to 80, or 12 to 40, carbon atoms per alkyl-substituted aromatic moiety depending on their source. When neutralising alkylaryl sulfonic acids to obtain sulfonates, the reaction mixture used may also include hydrocarbon solvents and/or diluent oils, as well as promoters and viscosity-control agents. Such procedures may be described in the art.

Another type of sulfonic acid that may be used is an alkylphenol sulfonic acid, which may be sulfurised. When the sulfonic acid is an alkyl sulfonic acid, the alkyl group may contain 9 to 100, advantageously 12 to 80, especially 16 to 60, carbon atoms.

The hydroxybenzoic acid, when used as the organic acid, may be a hydrocarbyl-substituted hydroxybenzoic acid where hydrocarbyl includes alkyl or alkenyl. The hydrocarbyl group may be in the ortho, meta or para position with respect to the hydroxyl group; there may be more than one hydrocarbyl group attached to the benzene ring. Such hydrocarbyl groups are preferably alkyl (branched or, more preferably straight-chain) when they advantageously contain 5 to 100, preferably 9 to 30, especially 14 to 24, carbon atoms.

Hydroxybenzoic acids are typically prepared, as may be described in the art, by rarboxylating phenoxides using the Kolbe-Schmitt process when they are generally obtained (normally in a diluent) in admixture with uncarboxylated phenol. The acids may be sulfurised or non-sulfurised, and may be chemically modified and/or contain additional substituents.

Mixed metal detergents, as employed in this invention, may be made by reacting an organic acid, dissolved in an oil, with a compound of a first metal (e.g. an oxide or a hydroxide) and subsequently with a compound of a second metal (e.g. an oxide or a hydroxide). Overbasing may be provided by means of an acidic gas such as carbon dioxide. The examples herein specifically describe such a preparation method, GB-A-818,323 describes a process for the preparation of oil-soluble basic organic and salts containing as cations two or more different metals.

The detergent used in this invention (i.e. the mixed metal detergent) is either: an oil-soluble overbased hydroxybenzoate including both magnesium and calcium cations; or an oil-soluble overbased sulfonate including both magnesium and calcium cations. The detergent is not a mixture of an oil-soluble overbased magnesium detergent and an oil-soluble overbased calcium detergent. The detergent used in the present invention (i.e. the mixed metal detergent) is prepared in the presence of both magnesium and calcium compounds such as, for example, a magnesium oxide or hydroxide and a calcium oxide or hydroxide, before the addition of or before the final addition of an acidic gas such as carbon dioxide.

The weight ratio of Ca to Mg in the detergent may be 10:1 to 1:10, preferably 8:3 to 4:5, more preferably 1:1 to 1:3.

The detergent additive may deliver to the lubricating oil composition from 50 to 8000 ppm Ca by weight and from 50 to 6000 ppm Mg by weight.

The total sulfonated ash of the lubricating composition may, for example, be less than 1 mass %, where the contributions of each of the Ca and Mg are preferably less than 0.8%, such as less than 05, or less than 0.2 mass %.

Preferably, detergent in total is used in an amount providing the composition with 0.5 to less than 2.0, such as from 0.7 to less than 1.4, preferably 0.6 to less than 1.2, mass % of sulfated ash.

Co-Additives

The lubricating oil compositions of all aspects of the present invention may further comprise a phosphorus-containing compound.

Suitable phosphorus-containing compounds include dihydrocarbyl dithiophosphate metal salts, which are frequently used as antiwear and antioxidant agents. The metal is preferably zinc, but may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$, and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

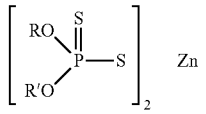

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be 5 or greater. The zinc dihydrocarbyl dithiophosphate (ZDDP) can therefore comprise zinc dialkyl dithiophosphates. Lubricating oil compositions of the present invention suitably may have a phosphorus content of no greater than about 0.08 mass % (800 ppm). Preferably, in the practice of the present invention, ZDDP is used in an amount close or equal to the maximum amount allowed, preferably in an amount that provides a phosphorus content within 100 ppm of the maximum allowable amount of phosphorus. Thus, lubricating oil compositions useful in the practice of the present invention preferably contain ZDDP or other zinc-phosphorus compounds, in an amount introducing from 0.01 to 0.08 mass % of phosphorus, such as from 0.04 to 0.08 mass % of phosphorus, preferably, from 0.05 to 0.08 mass % of phosphorus, based on the total mass of the lubricating oil composition.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. Typical oil-soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen are also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 mass %.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants in this invention are preferably "ashless", as mentioned above, being non-metallic organic materials that form substantially no ash on combustion, in contrast to metal-containing and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkyene polyamines with alkenyl succinic anhydrides, such as described in U.S. Pat. No. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025), fluorinated or oxylated. For example, boration may be accomplished by treating an acyl nitrogen-containing dispersant with a boron compound selected from boron oxide, boron halides, boron acids and esters of boron acids.

Preferably, the dispersant, if present, is a succinimide dispersant derived from as polyisobutene of number average molecular weight in the range of 1000 to 3000, preferably 1500 to 2500, and of moderate functionality. The succinimide is preferably derived from highly reactive polyisobutene.

Another example of dispersant type that may be used is a linked aromatic compound such as described in EP-A-2 090 642.

Additional additives may be incorporated into the compositions of the invention to enable particular performance requirements to be met. Examples of additives which may be included in the lubricating oil compositions of the present invention are metal rust inhibitors, viscosity index improvers, corrosion inhibitors, oxidation inhibitors, friction modifiers, anti-foaming agents, anti-wear agents and pour point depressants. Some are discussed in further detail below.

Friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with dials, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4 \text{ and}$$

$$Mo(RSCS_2)_4$$

wherein R is an organo group selected from the group consisting of alkyl, aryl, aralkyl and alkoxyaikyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligand organo groups, such as at least 25, at least 30, or at least 35, carbon atoms.

Lubricating oil compositions useful in all aspects of the present invention preferably contain at least 10 ppm, at least 30 ppm, at least 40 ppm and more preferably at least 50 ppm molybdenum. Suitably, lubricating oil compositions useful in all aspects of the present invention contain no more than 1000 ppm, no more than 750 ppm or no more than 500 ppm of molybdenum. Lubricating oil compositions useful in all aspects of the present invention preferably contain from 10 to 1000, such as 30 to 750 or 40 to 500, ppm of molybdenum (measured as atoms of molybdenum).

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from 5,000 to 250,000, preferably from 15,000 to 200,000, more preferably from 20,000 to 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

As used herein in connection with polymer block composition, "predominantly" means that the specified monomer or monomer type that is the principle component in that polymer block is present in an amount of at least 85% by weight of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

The block copolymers may include mixtures of linear diblock polymers as disclosed above, having different molecular weights and/or different vinyl aromatic contents as well as mixtures of linear block copolymers having different molecular weights and/or different vinyl aromatic contents. The use of two or more different polymers may be preferred to a single polymer depending on the rheological properties the product is intended to impart when used to produce formulated engine oil. Examples of commercially available styrene/hydrogenated isoprene linear diblock copolymers include Infineum SV140™, Infineum SV150™ and Infineum SV160™, available from Infineum USA L.P. and Infineum UK Ltd.; Lubrizol™ 7318, available from The Lubrizol Corporation; and Septon 1001™ and Septon 1020™, available from Septon Company of America (Kuraray Group). Suitable styrene/1,3-butadiene hydrogenated block copolymers are sold under the tradename Glissoviscal™ by BASF.

Pour point depressants (PPD), otherwise known as lube oil flow improvers (LOFIs) lower the temperature. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

In the present invention it may be necessary to include an additive which maintains the stability of the viscosity of the blend. Thus, although polar group containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed. In another preferred embodiment, the lubricating oil compositions of the present invention contain an effective amount of a long chain hydrocarbons functionalized by reaction with mono- or dicarboxylic acids or anhydrides.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed (with the exception of detergent values) are stated as mass percent active ingredient (A.I.).

| ADDITIVE | MASS % (Broad) | MASS % (Preferred) |
|---|---|---|
| Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2.5 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Viscosity Modifier | 0.01-10 | 0.25-3 |
| Base stock | Balance | Balance |

Preferably, the Noack volatility of the fully formulated lubricating oil composition (oil of lubricating viscosity plus all additives) will be no greater than 18, such as no greater than 14, preferably no greater than 10, mass %. Lubricating oil compositions useful in the practice of the present invention may have an overall sulfated ash content of from 0.5 to 2.0, such as from 0.7 to 1.4, preferably from 0.6 to 1.2, mass %.

It may be desirable, although not essential to prepare one or more additive concentrates comprising additives (concentrates sometimes being referred to as additive packages) whereby several additives can be added simultaneously to the oil to form the lubricating oil composition.

The final composition may employ from 5 to 25, preferably 5 to 22, typically 10 to 20, mass % of the concentrate, the remainder being oil of lubricating viscosity.

This invention will be further understood by reference to the following examples, wherein all parts are parts by mass, unless otherwise noted and which include preferred embodiments of the invention. The examples are not intended to limit the scope of the claims hereof.

EXAMPLES

Preparation of a Mixed Metal Sulfonate Detergent

To a reactor was added Sulfonic acid 1 ($C_{12}$ linear, 60 g), methanol (21 g) and toluene (495 g). Using a Rushton turbine stirrer, this was mixed at a constant speed (400 rpm) to ensure sufficient agitation. Magnesium Oxide (114.5 g) and an EDA (ethylene diamine) carbamate solution (77 g, comprising methanol (21.9 g), water (32.9 g) and EDA carbamate (22.2 g)) were then added, the temperature raised to 40° C. and held for 15 minutes.

Further toluene (150 g) and sulfonic acid 2 ($C_{36}$ branched, 334 g) were added, followed by additional methanol (66 g), and after 45 minutes and with the temperature stabilised at 45° C., carbon dioxide (93.9 g) was added over 90 minutes.

Twenty-five, minutes after the completion of the carbon dioxide addition, and with the temperature stabilised at 60° C., calcium hydroxide (116.4 g) was charged, followed by further carbon dioxide (89.0 g) added over 90 minutes. After completion, the resulting reaction mixture was diluted with Group I mineral oil (423 g), fumeric acid (27 g) added and all solvents removed in vacuo.

The reaction mixture was diluted with toluene (645 g) and centrifuged at 2500 rpm, after which the toluene was removed in vacuo.

The mixed metal sulfonate contained 4.4% Ca, 5.5% Mg and 1.3% S (D4951); and had a TBN of 364.5 (D2896).

Preparation of a Mixed Metal Salicylate Detergent

To a reactor was added alkylsalicylic acid (250 g) and xylene (1039 g). Using a Rushton turbine stirrer, this was mixed at a constant speed (200 rpm) to ensure sufficient agitation whilst being heated to 50° C.

At approximately 30° C., calcium hydroxide (107.4 g) was added followed by magnesium oxide (58.4 g).

Once the heat profile reached 50° C., methanol (148.7 g) and water (32.7 g) were added. The stirring was then increased to 400 rpm and the reaction mixture held at 50° C. for 60 minutes.

Carbon dioxide (66.4 g) was added over 90 minutes. After the complete addition of carbon dioxide, the reaction mixture was held at 50° C. for a further 60 minutes.

The reaction mixture was centrifuged at 2500 rpm. The supernatant liquid was then diluted with Group I mineral oil (260 g) and the solvents removed in vacuo.

The mixed metal salicylate contained in 7.1% Ca and 2.3% Mg (D4951); and had a TBN of 300.4 (D2896).

Tests

Daimler oxidation tests and LSPI performance tests were carried out on the above mixed metal sulphonate detergent and, for comparison purposes, on an analogous mixture of: an overbased Ca sulphonate detergent and an overbased Mg sulphonate detergent. Otherwise identical PCMO's, containing the detergents, were used in the tests. The PCMO's were blended to have identical TBN's.

The test methods are described as follows:

The Daimler Oxidation test is used to measure the effect of biofuel on gasoline and diesel engine oil. The oil is subjected to extended periods at elevated temperature with a continual supply of air being passed through, in the presence of biofuel and a ferrous catalyst. The test conditions are summarised below. Two parameters are studied in order to rank relative performance, end of test viscosity (kV100), and overall oil oxidation (measured by Infra Red, peak area increase (PAI)). This uses the same apparatus as the GFC Oxidation Test (Reference Number: T021-A-90).

| | |
|---|---|
| Duration | 168 hours |
| Temperature | 160° C., measured in oil bath |
| Air flow rate | 10 L/h |
| Oil Charge | 250 g |
| Catalyst | 100 ppm Fe |
| Fuel | 5% B100, 80% RME/20% SME from OM646 deposit test |
| Sampling | 72, 96, 120, 144 and 168 hours |
| Analysis | KV100 and oxidation by peak height (DIN 51453) |

Two engines have been used to measure the occurrence of LSPI events during engine operation, the GM Ecotec 2.0 L engine and the For Ecoboost 20.L engine. The P3 LSPI test uses a GM Ecotec 2.0 L Turbocharged LHU engine and comprises the following stages during testing:

Two 25 minutes segments of High Load High Speed at 2,000 RPM/280 Nm

Two 33 minute segments of Low Load Low Speed at 1500 RPM/207 Nm

Two 25 minute segments of High Load High Speed at 2,000 RPM/280 Nm.

This comprises a total 25,000 cycles per segment. The total number of peak cylinder pressure events ('LSPI events') are measured and reported.

Results

Mixed Metal Sulfonate Detergent:

| | Sulfated Ash | TBN | Ca | Mg | LSPI Events | Relative Viscosity Increase (%) | Oxidation (PAI) |
|---|---|---|---|---|---|---|---|
| Mixed Metal (Ca and Mg) Sulfonate Detergent | 0.97 | 10.5 | 0.10 | 0.13 | 3 | 26.1 | 76.8 |
| Mixture of: Ca Sulfonate Detergent and Mg Sulfonate Detergent (Comparative Example) | 0.91 | 10.5 | 0.11 | 0.12 | 11 | 32.2 | 96.9 |

*PAI means peak area increase

The results show that surprisingly the mixed metal detergent of the invention gave rise to better results (i.e. lower values) in comparison with a mixture of a calcium detergent and a magnesium detergent, when each provided equivalent chemical properties to the PCMO.

What is claimed is:

1. A method for reducing low-speed pre-ignition events and/or improving oxidation performance in a spark-ignited direct injection internal combustion engine, the method comprising lubricating the crankcase of the engine, that in operation is susceptible to the occurrence of low-speed pre-ignition events, with a lubricating oil composition which comprises a detergent additive comprising an oil-soluble basic organic acid salt including at least magnesium and calcium as cations, wherein the weight ratio of calcium to magnesium is 1:1 to 1:3, and the organic acid is an alkyl-substituted hydroxy-benzoic acid or a sulfonic acid, and operating the engine.

2. The method as claimed in claim 1, wherein the detergent additive is an oil-soluble sulfonate including at least magnesium and calcium as cations; or an oil-soluble salicylate including at least magnesium and calcium as cations.

3. The method as claimed in claim 2, wherein the detergent additive is an oil-soluble salicylate including at least magnesium and calcium as cations.

4. The method of claim 1, wherein the lubricating oil composition is a passenger car motor oil.

5. The method of claim 2, wherein the lubricating oil composition is a passenger car motor oil.

6. The method of claim 1, wherein the total sulfated ash content of the lubricating oil composition is less than 1%.

7. The method of claim 1, wherein the Ca and Mg contributions to the total sulfated ash content are each less than 0.5%.

8. The method of claim 2, wherein the total sulfated ash content of the lubricating oil composition is less than 1%.

9. The method of claim 8, wherein the Ca and Mg contributions to the total sulfated ash content are each less than 0.5%.

10. The method of claim 3, wherein the total sulfated ash content of the lubricating oil composition is less than 1%.

11. The method of claim 10, wherein the Ca and Mg contributions to the total sulfated ash content are each less than 0.5%.

12. The method of claim 1, wherein the detergent additive delivers to the lubricating oil composition from 50 to 8000 ppm Ca by weight and from 50 to 6000 ppm Mg by weight.

13. The method of claim 12, wherein the Ca and Mg contributions to the total sulfated ash content are each less than 0.5%.

14. The method of claim 2, wherein the detergent additive delivers to the lubricating oil composition from 50 to 8000 ppm Ca by weight and from 50 to 6000 ppm Mg by weight.

15. The method of claim 14, wherein the Ca and Mg contributions to the total sulfated ash content are each less than 0.5%.

16. The method of claim 3, wherein the detergent additive delivers to the lubricating oil composition from 50 to 8000 ppm Ca by weight and from 50 to 6000 ppm Mg by weight.

17. The method of claim 16, wherein the Ca and Mg contributions to the total sulfated ash content are each less than 0.5%.

18. A method for reducing low-speed pre-ignition events and/or improving oxidation performance in a spark-ignited direct injection internal combustion engine, the method comprising lubricating the crankcase of the engine, that in operation is susceptible to the occurrence of low-speed pre-ignition events, with a lubricating oil composition which comprises an oil-soluble calcium and magnesium sulfonate or an oil-soluble calcium and magnesium salicylate, where the weight ratio of calcium to magnesium is 1:1 to 1:3, as a detergent additive, and operating the engine.

19. The method as claimed in claim 18, wherein the detergent additive is an oil-soluble calcium and magnesium salicylate.

20. The method as claimed in claim 1, wherein the alkyl of the alkyl-substituted hydroxybenzoic acid contains 5 to 100 carbon atoms.

21. The method as claimed in claim 1, wherein the alkyl of the alkyl-substituted hydroxybenzoic acid contains 9 to 30 carbon atoms.

22. The method as claimed in claim 1, wherein the alkyl of the alkyl-substituted hydroxybenzoic acid contains 14 to 24 carbon atoms.

23. The method as claimed in claim 1, wherein the alkyl of the alkyl-substituted hydroxybenzoic acid is branched or straight-chain.

* * * * *